United States Patent [19]

Abe

[11] Patent Number: 4,752,274

[45] Date of Patent: Jun. 21, 1988

[54] COIN DISPENSING APPARATUS HAVING COIN TRANSPORTING ARMS SYNCHRONIZED ON COMMON SURFACE WITH COIN SCRAPPING ARMS

[75] Inventor: Hiroshi Abe, Tokyo, Japan

[73] Assignee: Asahi Seiko Kabushiki Kaisha, Tokyo, Japan

[21] Appl. No.: 852,728

[22] Filed: Apr. 15, 1986

[30] Foreign Application Priority Data

Jun. 7, 1985 [JP] Japan ..... 60-122626

[51] Int. Cl.[4] ..... G07D 9/04

[52] U.S. Cl. ..... 453/32; 453/33; 453/35; 453/57

[58] Field of Search ..... 133/3 R, 3 A, 3 B, 3 C, 133/3 D, 3 E, 3 F, 3 G, 3 H, 4 R, 4 A, 5 R, 8 R; 453/32–35, 49, 57

[56] References Cited

FOREIGN PATENT DOCUMENTS 52-85895 7/1977 Japan .
55-48634 12/1980 Japan .
59-80873 5/1984 Japan .
60-57867 4/1985 Japan .
1445089 8/1976 United Kingdom .

*Primary Examiner*—F. J. Bartuska
*Attorney, Agent, or Firm*—Parkhurst & Oliff

[57] ABSTRACT

A coin dispensing apparatus is disclosed including a cylindrical coin container mounted on a substrate and connected to the bottom of a hopper for storing coins, a coin transporting rotary disc being rotated on the substrate in the container and having a plurality of coin receiving apertures and transporting arms radially extending between each adjacent pair of the apertures on the bottom of the rotary disc with a radial length such that their outer ends do not extend beyond a circle upon which lie the centers of the apertures, an outlet guide member mounted on the substrate in the container at the outlet portion opening an outlet slot and a scraper being rotated on the substrate outside the container synchronously with the rotary disc and having radial scraping arms of the same numbers as that of the transporting arms. The scraper is arranged such that the coins transported on the substrate by the transporting arms in the container are effectively scraped out the container by the scraping arms when the rotary disc is rotated at high speed so that the dispensation speed can be largely increased.

3 Claims, 4 Drawing Sheets

COIN DISPENSING APPARATUS HAVING COIN TRANSPORTING ARMS SYNCHRONIZED ON COMMON SURFACE WITH COIN SCRAPPING ARMS

BACKGROUND OF THE INVENTION

1. Field of the Invention

The present invention relates to apparatus for dispensing coins or tokens. More particularly, it relates to coin dispensing apparatus including a hopper for storing coins in bulk and a rotary disc for delivering the coins from the hopper one at a time and in specific quantities.

2. Related Art Statement

Various coin dispensing apparatus have been known and in particular, an apparatus as disclosed in Japanese Patent Application Publication No. 48,634/1980 to the assignor of the present application or U.K. Patent No. 1,445,089 to Coin Controls Limited has been known as a miniature type coin dispensing apparatus.

Such a miniature type coin dispensing apparatus comprises an inclined substrate, a cylindrical coin container mounted on the substrate, a hopper connected to the top mouth of the coin container for storing coins, a coin transporting rotary disc rotatably mounted on the substrate within the coin container for rotation concentrically with the coin container, means for rotationally driving the rotary disc, an outlet slot provided at the bottom of an outlet portion of the side wall of the coin container and outlet guide means positioned at the outlet portion of the coin container to engage coins entrained by the rotary disc and thereby to cause the course of the coins to direct toward the outlet slot. The coin transporting rotary disc has a plurality of coin receiving apertures spaced apart circumferentially and of diameter to accept the coin to be dispensed and also has a plurality of coin transporting arms radially extending between each adjacent pair of the apertures on the bottom of the rotary disc, whereby coins passing through said apertures to be supported by the substrate are entrained by the coin transporting arms to be transported in the circumferential direction within the coin container when the coin transporting rotary disc is rotated. The coin transporting arms have a radial length such that their outer ends do not extend substantially beyond a circle upon which lie the centers of the coin receiving apertures in order to prevent the arms from interferring with the outlet guide member positioned at the outlet portion of the coin container as mentioned above.

In the coin dispensing apparatus disclosed in the above Japanese Patent Application Publication, each of the transporting arms transports a coin on the substrate in the circumferential direction along the inner side wall of the coin container and at the outlet portion of the coin container cooperates with the guide means to cause the course of the coins to direct toward the outlet slot, but can not push the coin out of the container through the outlet slot in the side wall of the coin container since the radial length of the transporting arms is not enough long to push the coin out of the coin container. Therefore, the coins engaged with the outlet guide means and changed their course toward the outlet slot by the transporting arms must be pushed out of the coin container by the succeeding coins entrained by another transporting arms.

However, such a coin dispensing apparatus has disadvantages that the last one coin left in the coin container can not be subjected the pushing force by to the succeeding coin as mentioned above and therefore one coin usually remains in the coin container and the rate of dispensation is limited by numbers of coin receiving apertures and also by the speed of rotation of the rotary disc since when the speed of rotation of the rotary disc is increased, the coins are often jammed or wedged at the outlet portion.

As a solution to the above problem, the inventor of the present invention has tried to increase the radial length of the transporting arms such that their outer ends extend to the outer periphery of the rotary disc as disclosed in Japanese Patent Application Laid-Open Publication No. 85,895/1977. This solution can dispense the all of coins from the coin container, but does not solve the problem of limited speed of dispensation.

Furthermore, the inventor has proposed as disclosed by Japanese Utility Model Application Laid-Open Publication Nos. 80,873/1984 and 57,867/1985 to provide a recess or pitfall in the substrate at the outlet portion of the coin container such that coins transported by the transporting arms or the coin receiving apertures of the rotary disc on the substrate are dropped in the pitfall and to provide a scraper having a plurality of scraping arms radially extending from the central portion at which the scraper is mounted on a scraper shaft at the out side of the coin container such that the outer ends of the rotating scraping arms enter successively into the pitfall, whereby dropped coins in the pitfall are scraped out by the scraping arms.

It is however found that such arrangement of the pitfall and the scraper has a disadvantage that the coins dropped in the pitfall are not subjected to any controlled feed action by the transporting arms and this results in that the scraping arms of the scraper do not effectively engage the coins in the pitfall so that the coins can not be effectively scraped out the pitfall by the scraper and are often caused to jam at the outlet portion and therefore the dispensation speed can not be increased as expected.

SUMMARY OF THE INVENTION

In view of the foregoing, it is a principal object of the present invention to provide a coin dispensing apparatus of miniature type having a high dispensation speed.

According to the present invention, a coin dispensing apparatus comprises a substrate, a cylindrical coin container mounted on the substrate, a hopper connected to the top mouth of the coin container for storing coins, a coin transporting rotary disc rotatably mounted on the substrate within the coin container, the rotary disc having a plurality of coin receiving apertures spaced apart circumferentially and further having a plurality of coin transporting arms radially extending between each adjacent pair of the apertures on the bottom of the rotary disc, said coin transporting arms having a radial length such that their outer ends do not extend beyond a circle upon which lie the centers of the coin receiving apertures, means for rotating the rotary disc, an outlet slot provided at the bottom of the side wall of the coin container at the outlet portion thereof, outlet guide means positioned at the outlet portion of the coin container, a scraper having radial scraping arms of the same numbers as that of the coin transporting arms and being rotated on the substrate synchronously with the rotary disc such that the outer end portions of the scraping arms enter through an extended slot portion of the outlet slot under the rotary disc between each adjacent pair of the apertures, whereby coins transported on the substrate by the transporting arms are scraped out of the coin container by the scraping arms.

BRIEF DESCRIPTION OF THE DRAWINGS

Further objects and advantages of the present invention will become apparent as the following description of an illustrative embodiment proceeds with reference to the drawings in which.

DESCRIPTION OF THE PREFERRED EMBODIMENTS

Figure 1:
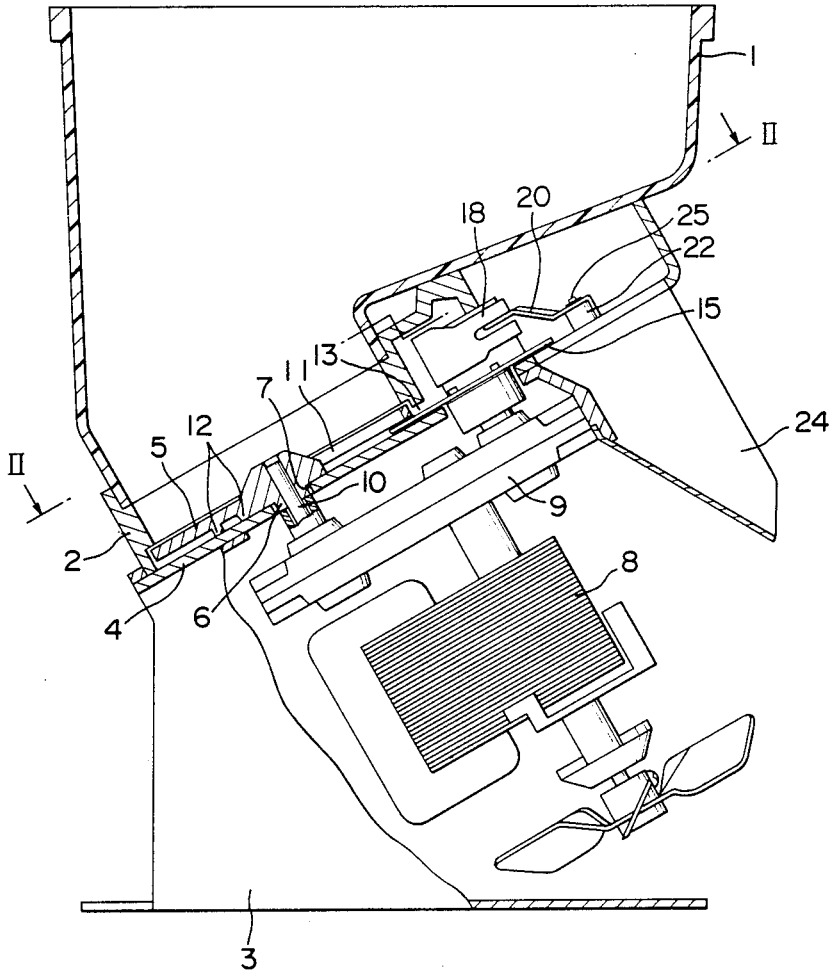
FIG. 1 is a sectional view of the coin dispensing apparatus according to the present invention.
Figure 2:
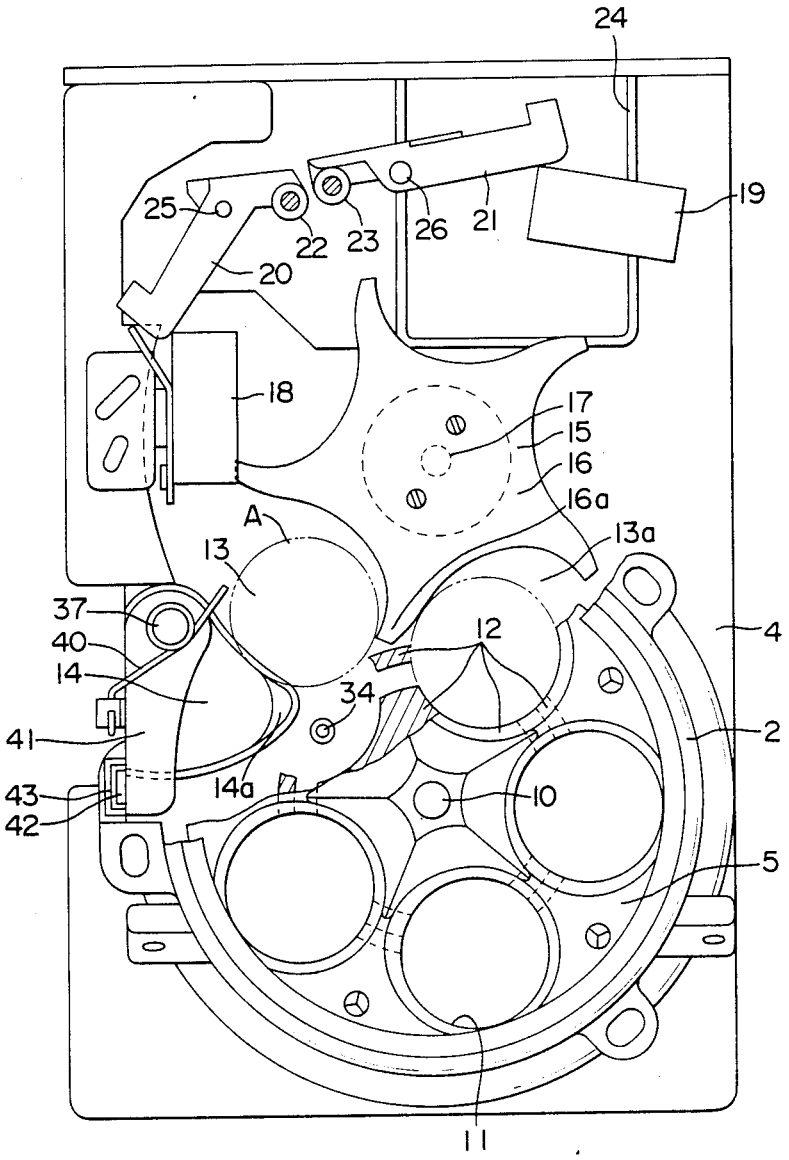
FIG. 2 is a plan view of the apparatus of FIG. 1 when taken generally along line II—II thereof with certain parts broken away.

With reference to drawings, it will be seen that a hopper 1 for storing coins is connected at the lower end thereof to the top mouth of a cylindrical coin container 2 which is mounted on an inclined substrate 4 at the lower portion thereof. This substrate 4 is supported in an inclined position by a supporting base 3.

Within the coin container 2, a coin transporting rotary disc 5 is rotatably mounted on the substrate 4 by inserting a cylindrical boss 6 of the rotary disc 5 into a hole 7 formed in the substrate 4 to rotate the rotary disc 5 concentrically with the container 2. The boss 6 is secured to a drive shaft 10 which is driven by means of an electric motor 8 through a transmission 9.

The rotary disc 5 has a plurality of coin receiving apertures 11 formed by extending through the rotary disc in positions spaced circumferentially. The apertures 11 have a diameter to accept the coin to be dispensed. The rotary disc 5 also has a plurality of coin transporting arms 12 radially extending between each adjacent pair of the apertures 11 on the bottom of the rotary disc 5. The space between the bottom of the rotary disc 5 and the surface of the substrate 4 is made sufficient freely to allow the passage of a coin of the size to be dispensed, but to prevent any possibility two thinned coins from becoming wedged in the space.

The transporting arm 12 has a thickness able to transport a coin which is passed through the aperture 11 and supported on the substrate 4 and also has a radial length such that its outer end does not extend substantially beyond a circle upon which lie the centers of the coin receiving apertures 11.

The lower rim of the cylindrical coin container 2 is partly cut away (FIG. 7) at the outlet portion thereof to form an outlet slot 13 allowing coins to leave the container.

At the downstream position of the outlet slot 13, an outlet guide member 14 and a retractable guide pin 34 are positioned on the substrate 4 to engage coins entrained by the transporting arms 12 and thereby to cause the course of the coins to direct toward the outlet slot 13.

On the substrate 4, a scraper 15 is arranged side by side with the rotary disc 5 at the outside of the outlet slot 13. The scraper 15 has radial scraping arms 16 of the same numbers as that of the coin transporting arms 12 of the coin transporting rotary disc 5.

Figure 7:
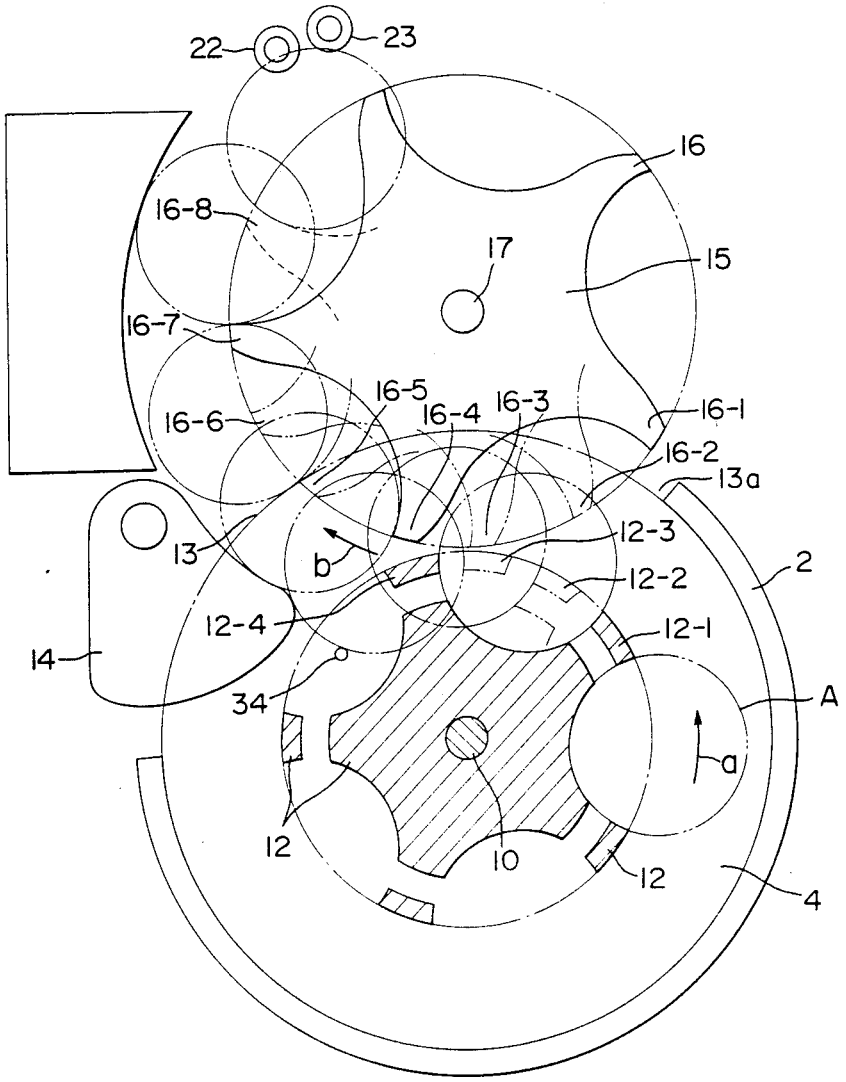
FIG. 7 is a diagrammatic plan view showing various positions of transporting arms and scraping arms.

The scraper 15 is secured at the central portion to a scraper shaft 17 which is rotated synchronously with the disc shaft 10 of the rotary disc 5 and arranged such that the outer end portions **16*a* of the scraping arms 16 enter the space between bottom with the transporting arms 12 of the rotary disc 5 and the surface of the substrate 4 within the container 2 and between each adjacent pair of the coin receiving apertures 11 through an extended slot portion 13*a* of the outlet slot 13, whereby each of coins entrained by the transporting arms 12 is scraped out the coin container 2 at the outlet portion thereof by each of the scraping arms 16 as shown in FIG. 7 which shows various positions 16-2, 16-3, 16-4 . . . of a scraping arm 16-1 coacting with a transporting arm 12-1 at successive positions 12-2, 12-3, 12-4**.

On the substrate 4, there are arranged two approximate coin counting switches 18 and 19 along the passage of coins scraped by the scraping arms.

The switches 18 and 19 have spring loaded rocker arms 20 and 21, respectively which are provided with counter rollers 22 and 23 rotatably supported on the arm free ends and are pivoted at 25 and 26 such that each of coins to be dispensed contacts substantially simultaneously with both of the rollers 22 and 23 before discharging through a discharge chute 24 to rotate the rocker arms 20 and 21 and thereby to actuate the switches 18 and 19 to effect the count of coins by double detecting.

Figure 3:
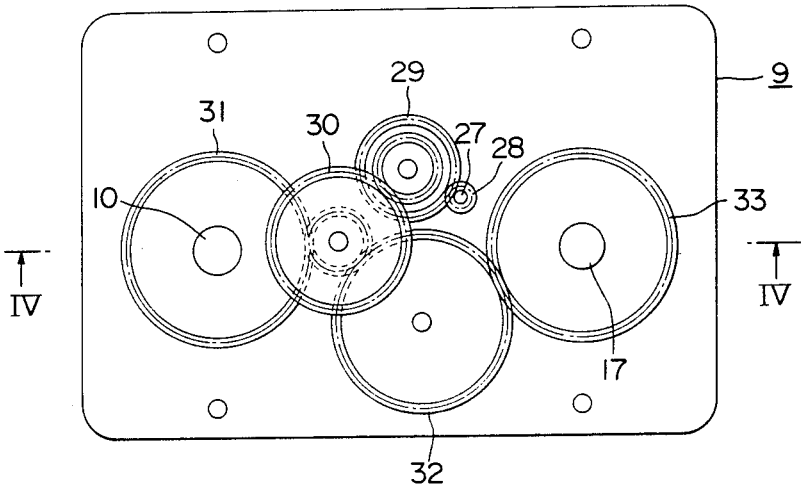
FIG. 3 is a diagrammatic plan view showing an arrangement of gears in a transmission.
Figure 4:
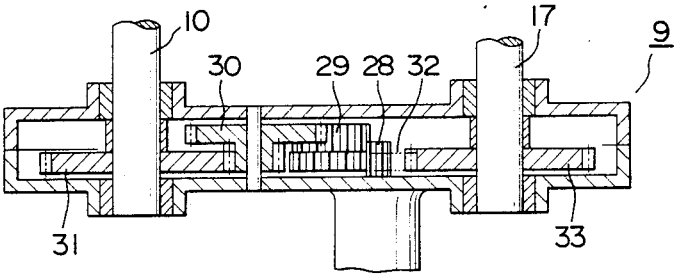
FIG. 4 is a sectional view taken along line IV—IV of FIG. 3.

Referring to FIGS. 3 and 4, the transmission 9 includes a pinion 28 on an output shaft 27 of the motor 8, a first reduction gear 29 engaged with the pinion 28 and a secondary reduction gear 30 which rotates the disc shaft 10 via a disc gear 31 in one direction and synchronously rotates the scraper shaft 17 via an intermediate gear 32 and a scraper gear 33 in opposite direction.

The outlet guide member 14 is retractable under the surface of the substrate 4 to allow the coin to pass beyond the guide member if the coin entrained by the transporting arm 12 can not be scraped out the container 2 through the outlet slot 13 by the scraping arm 16.

Figure 5:
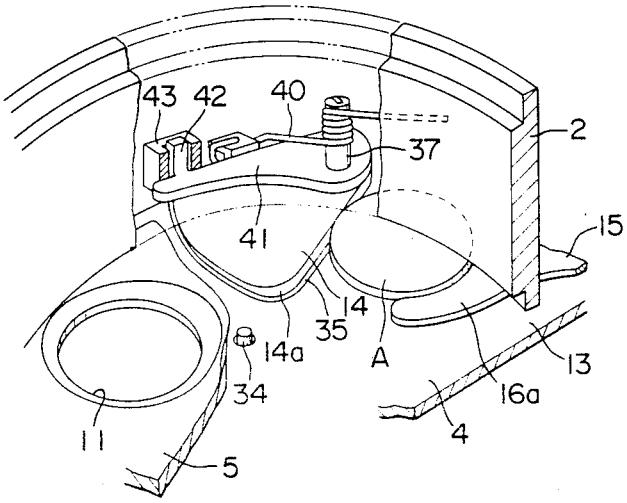
FIG. 5 is a perspective view of the outlet portion of the coin container with parts broken away.
Figure 6:
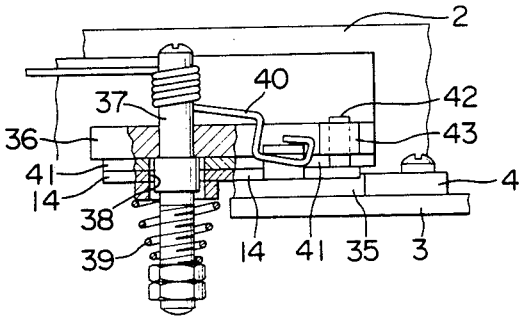
FIG. 6 is an elevational view of parts for supporting an outlet guide.

Referring to FIGS. 5 and 6, the outlet guide member 14 has a tapered tip **14*a* for causing a downward force by a coin and is downwardly slidable on the supporting post 37 against springs 39 and 40 so as to retract into a recess 35 formed in the substrate 4. On the post 37 which is fixed to a stational plate 36, an auxiliary side member 41 is also supported slidably together with the outlet guide member 14. The side member 41 has a lug 42 which is guided in a groove of a guide 43 on the plate 36 and a side for closing an opening which is generated in the side wall of the container 2 by lowering of the guide member 14 into the recess 35**.

It will be seen from the above mentioned that the coin dispensing apparatus according to the present invention, the coins transported on the substrate by the transporting arms 12 of the rotary disc 5 rotating in the cylindrical coin container 2 are effectively scrapped out the container through the outlet slot 13 by the scraping arms 16 of the scraper 15 which is rotated on the same surface of the substrate synchronously with the rotary disc 5 when the speed of rotation of the rotary disc 5 is increased so that the dispensation speed can be greatly increased.

What is claimed is:

1. A coin dispensing apparatus comprising a substrate, a cylindrical coin container mounted on the substrate, a hopper connected to the top mouth of the coin container for storing coins, a coin transporting rotary disc rotatably mounted on the substrate within the coin container, the rotary disc having a plurality of coin receiving apertures spaced apart circumferentially and further having a plurality of coin transporting arms radially extending between each adjacent pair of the apertures on the bottom of the rotary disc, said coin transporting arms having a radial length such that their outer ends do not extend beyond a circle upon which lie the centers of the coin receiving apertures, means for rotating the rotary disc, an outlet slot provided at the bottom of the side wall of the coin container at the outlet portion thereof, outlet guide means positioned at the outlet portion of the coin container, a scraper having radial scraping arms of the same number as that of the coin transporting arms and being rotated on the substrate synchronously with the rotary disc such that the outer end portions of the scraping arms enter through an extended slot portion of the outlet slot under the rotary disc between each adjacent pair of the apertures, whereby coins transported on the substrate by the transporting arms are scraped out the coin container by the scraping arms.

2. The apparatus as claimed in claim 1, the outlet guide means including an outlet guide member retractable in a recess formed in the substrate.

3. The apparatus as claimed in claim 1, the apparatus further comprising two coin counting switches arranged along the passage of coins scraped by the scraping arms.

* * * * *